US011197113B2

(12) United States Patent
Böhmer

(10) Patent No.: US 11,197,113 B2
(45) Date of Patent: Dec. 7, 2021

(54) STEREO UNFOLD WITH PSYCHOACOUSTIC GROUPING PHENOMENON

(71) Applicant: OMNIO SOUND LIMITED, Dorking (GB)

(72) Inventor: Bernt Böhmer, Bjärred (SE)

(73) Assignee: OMNIO SOUND LIMITED, Dorking (GB)

( * ) Notice: Subject to any disclaimer, the term of this patent is extended or adjusted under 35 U.S.C. 154(b) by 137 days.

(21) Appl. No.: 16/605,009

(22) PCT Filed: Mar. 23, 2018

(86) PCT No.: PCT/SE2018/050300
§ 371 (c)(1),
(2) Date: Oct. 13, 2019

(87) PCT Pub. No.: WO2018/194501
PCT Pub. Date: Oct. 25, 2018

(65) Prior Publication Data

US 2020/0304929 A1 Sep. 24, 2020

(30) Foreign Application Priority Data

Apr. 18, 2017 (SE) ..... 1750448-1

(51) Int. Cl.
*H04S 1/00* (2006.01)
*H04S 7/00* (2006.01)
(Continued)

(52) U.S. Cl.
CPC ..... *H04S 1/007* (2013.01); *G10L 19/022* (2013.01); *G10L 21/04* (2013.01); *H04S 7/307* (2013.01)

(58) Field of Classification Search
CPC ..... H04S 1/007; H04S 7/307; H04S 7/306; H04S 2400/15; G10L 19/002; G10L 21/04; H04R 3/12; H04R 5/02
(Continued)

(56) References Cited

U.S. PATENT DOCUMENTS 5,555,306 A 9/1996 Gerzon
5,671,287 A 9/1997 Gerzon
(Continued)

FOREIGN PATENT DOCUMENTS

EP 0276159 A2 7/1988
GB 2491722 A 12/2012
(Continued)

OTHER PUBLICATIONS

Bregman"Auditory Scene Analysis" The Perceptual Organization of Sound, A Bradford Book, The MIT Press.
(Continued)

*Primary Examiner* — David L Ton
(74) *Attorney, Agent, or Firm* — Moser Taboada

(57) ABSTRACT

The Stereo Unfold Technology solves the inherent problems in the stereo reproduction by utilizing modern DSP technology to extract information from the Left (L) and Right (R) stereo channels to create a number of new channels that feeds into processing algorithms. The Stereo Unfold Technology operates by sending the ordinary stereo information in the customary way towards the listener to establish the perceived location of performers in the sound field with great accuracy and then projects delayed and frequency shaped extracted signals forward as well as in other directions to provide additional psychoacoustically based clues to the ear and brain. The additional clues generate the sensation of increased detail and transparency as well as establishing the three dimensional properties of the sound sources and
(Continued)

the acoustic environment in which they are performing. The Stereo Unfold Technology manages to create a real believable three-dimensional soundstage populated with three-dimensional sound sources generating sound in a continuous real sounding acoustic environment.

16 Claims, 5 Drawing Sheets

(51) Int. Cl.
*G10L 19/022* (2013.01)
*G10L 21/04* (2013.01)

(58) Field of Classification Search
USPC ..... 381/1–23, 300, 303
See application file for complete search history.

(56) References Cited

U.S. PATENT DOCUMENTS

| | | | |
|---|---|---|---|
| 5,999,630 | A | 12/1999 | Iwamatsu |
| 6,111,958 | A | 8/2000 | Maher |
| 2013/0077792 | A1 | 3/2013 | Bruney |
| 2015/0071451 | A1 | 3/2015 | Moon |
| 2015/0189439 | A1 | 7/2015 | Starobin |

FOREIGN PATENT DOCUMENTS

| | | | |
|---|---|---|---|
| WO | WO-03009639 | A1 | 1/2003 |
| WO | WO-2007137232 | A2 | 11/2007 |
| WO | WO-2015184307 | A1 | 12/2015 |

OTHER PUBLICATIONS

International Search Report for patent application No. PCT/SE2018/050300, dated May 24, 2018.

STEREO UNFOLD WITH PSYCHOACOUSTIC GROUPING PHENOMENON

The original Stereo Unfold Technology improved upon ordinary stereo reproduction of sound by the use of DSP algorithms to extract information from normal stereo recordings and playback of the additional information layered in time through speaker drivers aiming not only forward but also in other directions. The Stereo Unfold Technology creates a real believable three-dimensional soundstage populated with three-dimensional sound sources generating sound in a continuous real sounding acoustic environment and it constitutes a significant improvement compared to ordinary stereo reproduction.

During the continued work with the Stereo Unfold Technology additional discoveries where made on how the human brain interprets sound and it became possible to improve the method. The new Enhanced Version of Stereo Unfold can now be used both with additional drivers that aim in other directions than forward towards the listener and without. Thus, the new Enhanced Version of Stereo Unfold is applicable on all types of existing standard loudspeakers and also on headphone listening. When used with forward only speaker drivers it now manages to deliver at least the same amount of improvement as the old method, with additional drivers it improves even further. On headphones it manages to move the perceived soundstage from within the listeners head on a string between the ears to the outside of the head. It does so without any prior information about the listener's physical properties, i.e. shape and size of ears, head and shoulders.

The improvements in Stereo Unfold EV have specifically been achieved through a better understanding of the psychoacoustic grouping phenomenon and its influence on the Unfold Process.

Stereo Unfold and Prior Art

There's an abundance of prior art in the audio DSP field that sets out to solve various issues present in sound reproduction. All of them use the same fundamental DSP building blocks like IIR filters, FIR filters, delays, Left minus Right extraction algorithms etc. but with different end results. Looking at prior art it becomes apparent that there are three major groups within the field that can be considered somewhat related to the Stereo Unfold Technology.

First there is prior art that outlines methods for achieving a wider stereo image. Those are predominantly focused on stereo speakers that have the left and right speaker located physically close together even possibly in a single enclosure. These all aim to widen the stereo image and mitigate the problems that arise with closely spaced stereo speakers.

Secondly there is another group of patent documents around what's called sound bars, i.e. a one box speaker positioned front center that replaces multiple surround speakers spread around in the listening room in a surround sound system. Within this group the aim is to give the listener the sensation of being within a surround sound field normally created using several speakers in front and at the back of a room. The sound bars utilize various techniques with drivers aimed in different directions together with DSP algorithms to create a surround sound experience.

In relation to the above explanations it may be mentioned that for instance the documents US2015/0189439 and US2015/0071451 both refer to this first and second group.

Thirdly there's an in general somewhat older group of prior art that aims to improve the stereo experience by aiming basically Left minus Right derived contents in other directions than forward. Since done before the DSP technology became readily available and cost effective the processing used is very basic and limited to what was possible at the time. The available technology severely reduced the realizable sound quality and since the results were mostly disappointing it seems that work within this group has come to an end.

The first group deals with the technical problem of having two speakers closely spaced and tries to achieve a result similar to having widely spaced stereo speakers. The second group tries to replicate a surround sound field in the listening room using only one speaker instead of several. The third group tries to improve the perceived ambiance when listening to stereo but is unsuccessful due to inadequate processing and does not address the psychoacoustic problems inherent to stereo. None of the above prior art groups deal with the general shortcomings of stereo, why stereo as a method is flawed and how the stereo technique can be improved. The Stereo Unfold Technology aims to solve these inherent problems within the stereo technique.

The Stereo Unfold Technology recreates a continuous spatial 3D sound field that is similar to a real acoustic event. Ordinary stereo reproduction can at best project a sound stage but the sound sources within that soundstage sound like they are paper cutouts of performers without any individual extension in depth and the paper cutouts perform in solitude without being in an acoustic space, much like flashlights suspended in a black room. The Stereo Unfold Technology creates a spatial 3D sound field but it is not at all the same experience as listening to a surround sound system. A surround sound system is at its core an extension of stereo with the same limitations as stereo. With the use of additional speakers located around the room it can create position information not only from the front between the left and right speakers but also other locations around in the room. Stereo Unfold have specifically been achieved through understanding of the psychoacoustic grouping phenomenon and the spatial sound processing in the human brain, it is an entirely different method and the result is a spatial 3D sound field that is audibly like a live acoustic event.

Unlike stereo widening processing the original locations of the individual sound sources is not significantly altered by the Stereo Unfold process. The Stereo Unfold processing increases the soundstage size but does so by adding back the missing ambient information from the acoustic environment in which the recording took place or the artificially created ambience if it's computationally of otherwise added to a recoding.

Furthermore, below some other prior art documents are discussed shortly. In U.S. Pat. No. 5,671,287 there is disclosed a method to create a directionally spread sound source which is predominantly aimed at processing mono signal sources to create a pseudo stereo signal. The method disclosed in U.S. Pat. No. 5,671,287 is not at all the same as the Stereo Unfold method according to the present invention and further disclosed below, Moreover, the target of the present invention and U.S. Pat. No. 5,671,287 are entirely unrelated.

Moreover, EP0276159 discloses a method to create artificial localization cues to improve sound immersion with headphones. The disclosed method uses common Head Related Transfer functions to create the directional cues and mentions addition of early and later reflections. The Stereo Unfold method according to the present invention restores the naturally occurring ambient to direct sound ratio in recordings by extracting the ambient information from the recording and then add it back using a signal processing method that facilitates psychoacoustic grouping. As should be understood from above, both the targets and methods of the present invention and EP0276159 are completely different.

Moreover, US20130077792 discloses a method for improved localization using novel head related transfer functions. This is again not at all the area of the Stereo Unfold method according to the present invention, both the goal and the processing methodology is entirely different. Stereo Unfold according to the present invention is not targeting improvements of localization or widening of the stereo playback soundstage. The individual signal sources (performers) in the reproduced recording does, after Stereo Unfold processing, not change localization within the soundstage to a great degree. The relatively small change of localization that does occur is a byproduct of the processing but not the goal. The goal is to recreate the direct to ambient sound ratio to achieve a more natural sounding recording. The added ambient energy does enlarge the sound stage but the by far predominant enlarging element is the ambient sound field from the recoding venue and not the change in location of the individual signal sources (performers).

Based on the above it should be clear that none of U.S. Pat. No. 5,671,287, EP0276159 and US20130077792 is of relevance in relation to the Stereo Unfold method according to the present invention.

Mono & Stereo

Figure 1:
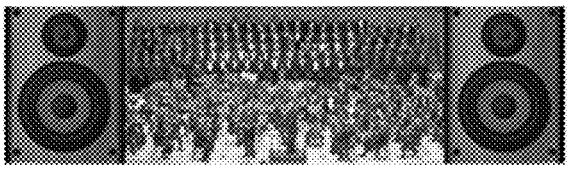
FIG. 1 (also referred to as Picture 1 herein) is an image of symphony orchestra and two speakers.
Figure 2:
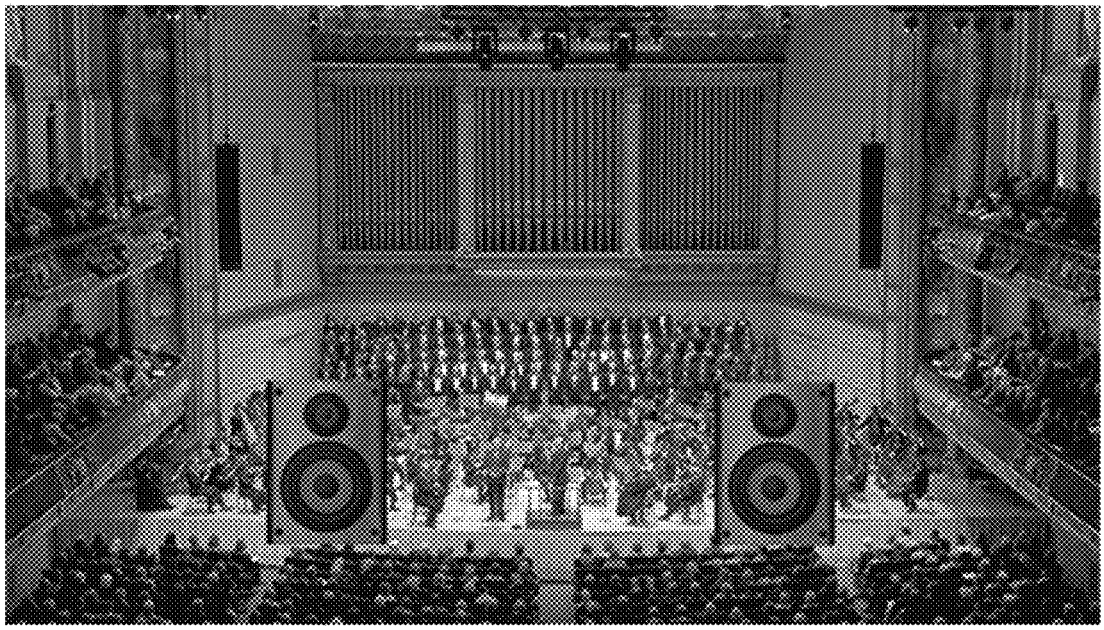
FIG. 2 (also referred to as Picture 2 herein) is an illustration of the perceived soundstage from Stereo Unfold.
Figure 3:
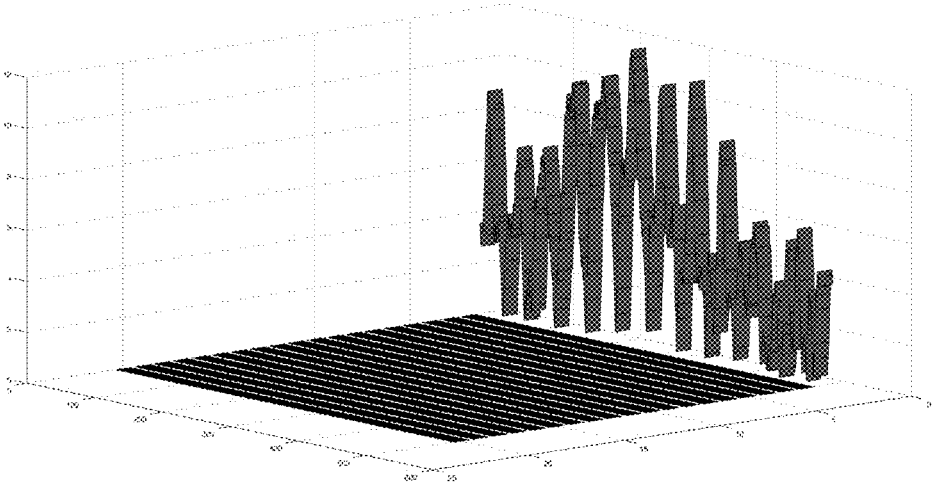
FIG. 3 (also referred to as Picture 3 herein) is a diagram of a channel of an ordinary digital stereo sound recording.
Figure 4:
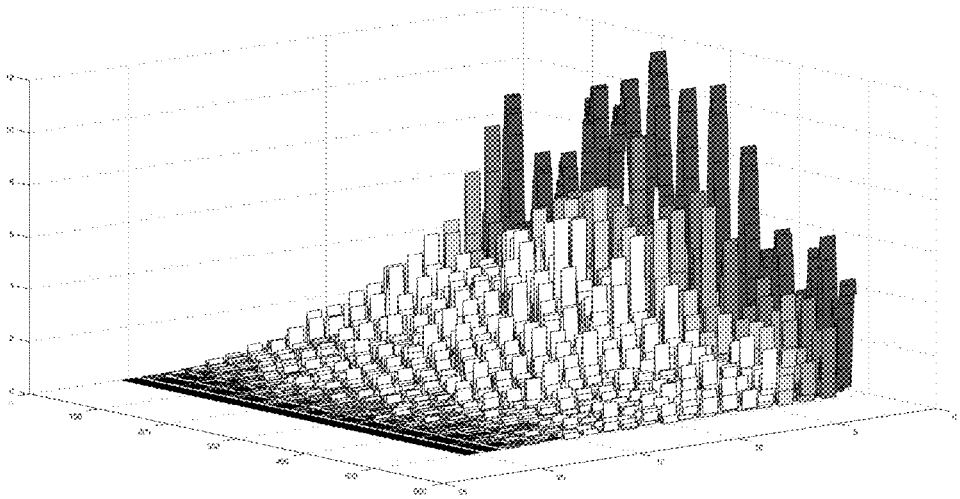
FIG. 4 (also referred to as Picture 4 herein) is the diagram of FIG. 3. after being Stereo Unfold processed.
Figure 5:
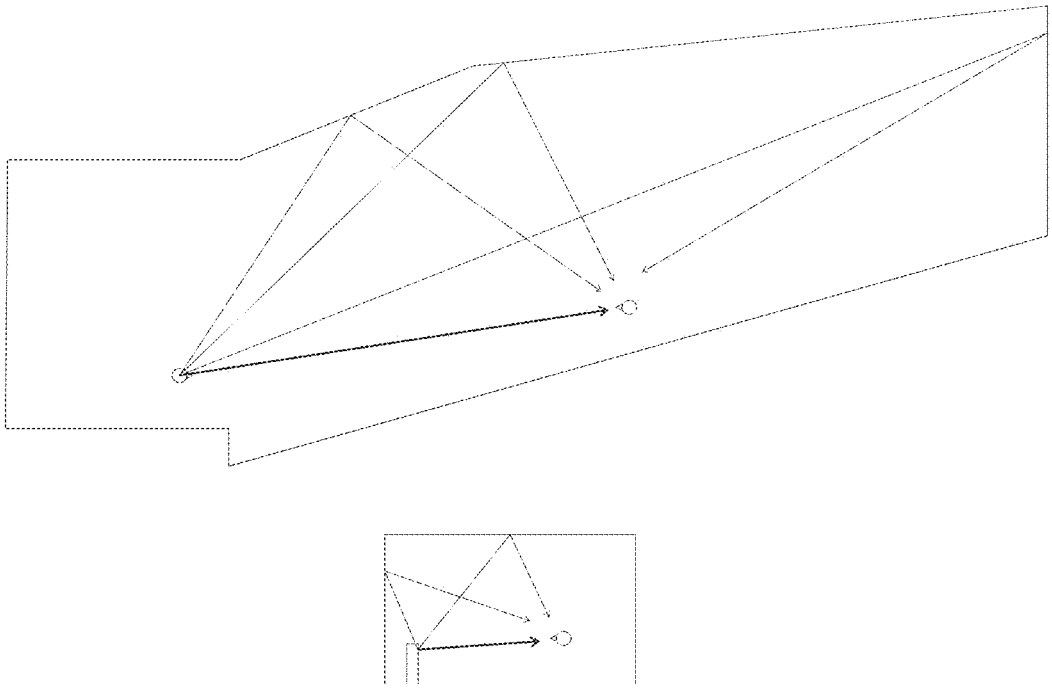
FIG. 5 (also referred to as Picture 5 herein) illustrates two cross sections of two rooms.
Figure 6:
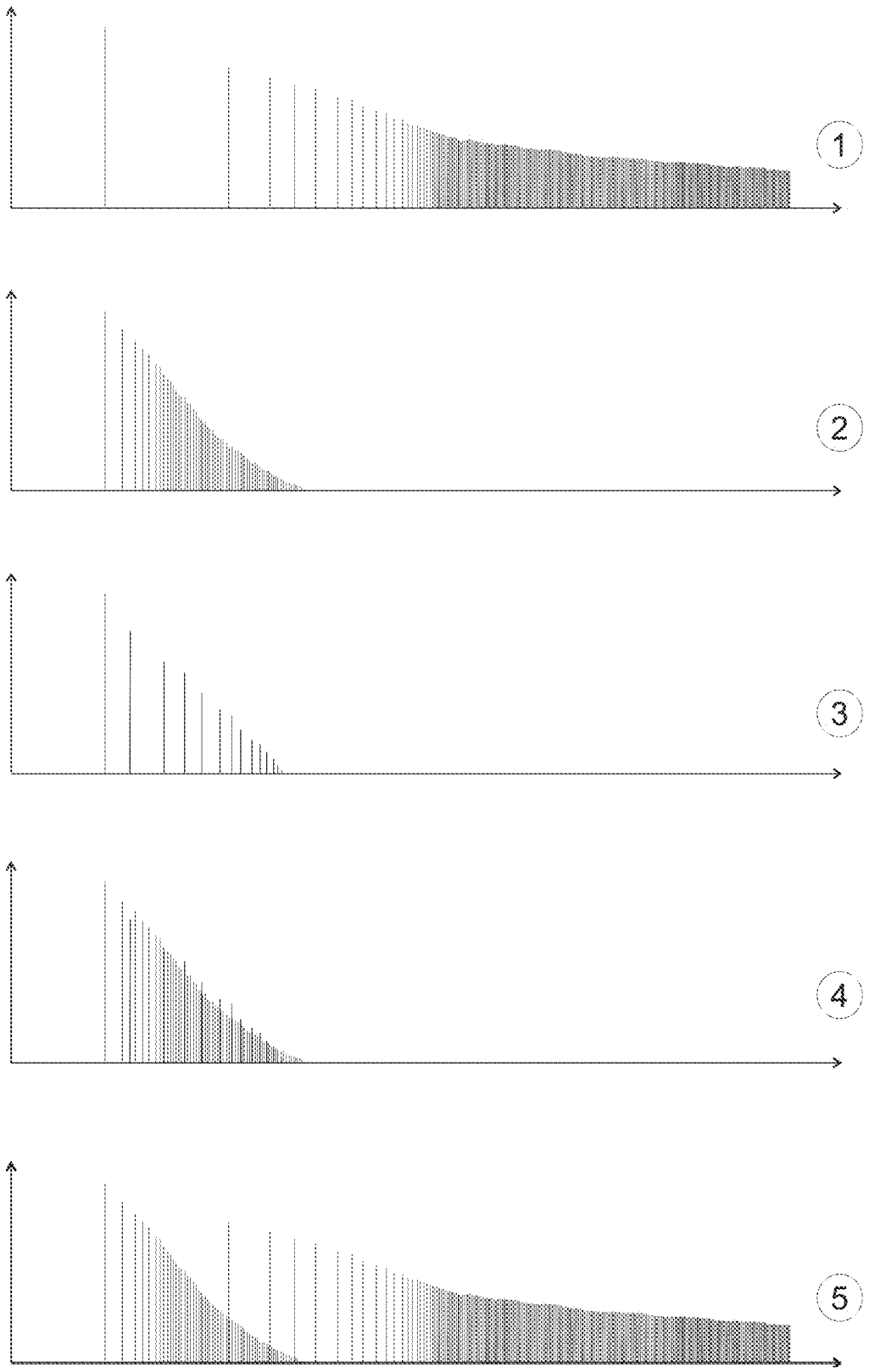
FIG. 6 (also referred to as Picture 6 herein) illustrates the arrival of sound at the listener's ears in five different diagrams.
Figure 7:
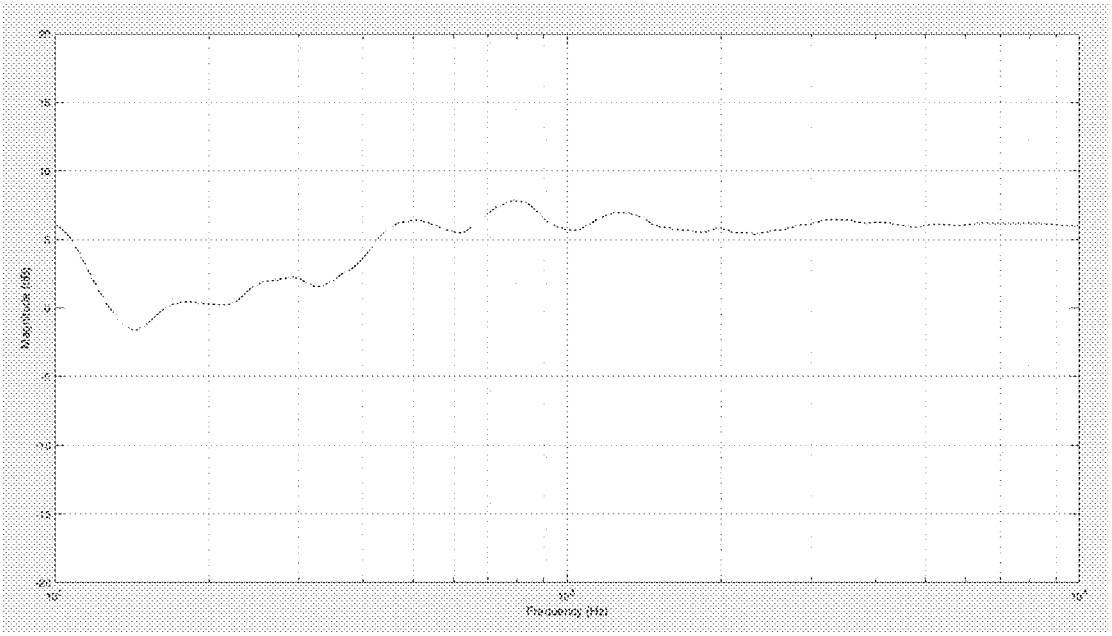
FIG. 7 (also referred to as Picture 7 herein) show a complex summation of sound pressure from multiple sources with random phase relationships.
Figure 8:
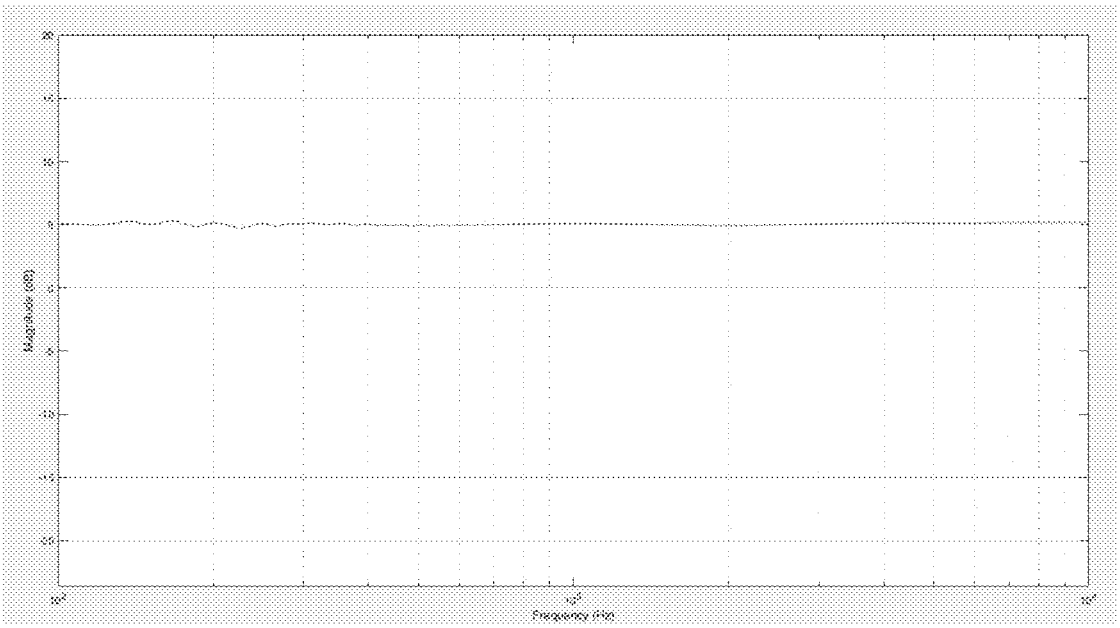
FIG. 8 (also referred to as Picture 8 herein) shows the same one octave smoothed frequency response with sympathetic grouping applied instead of random phase summation.
Figure 9:
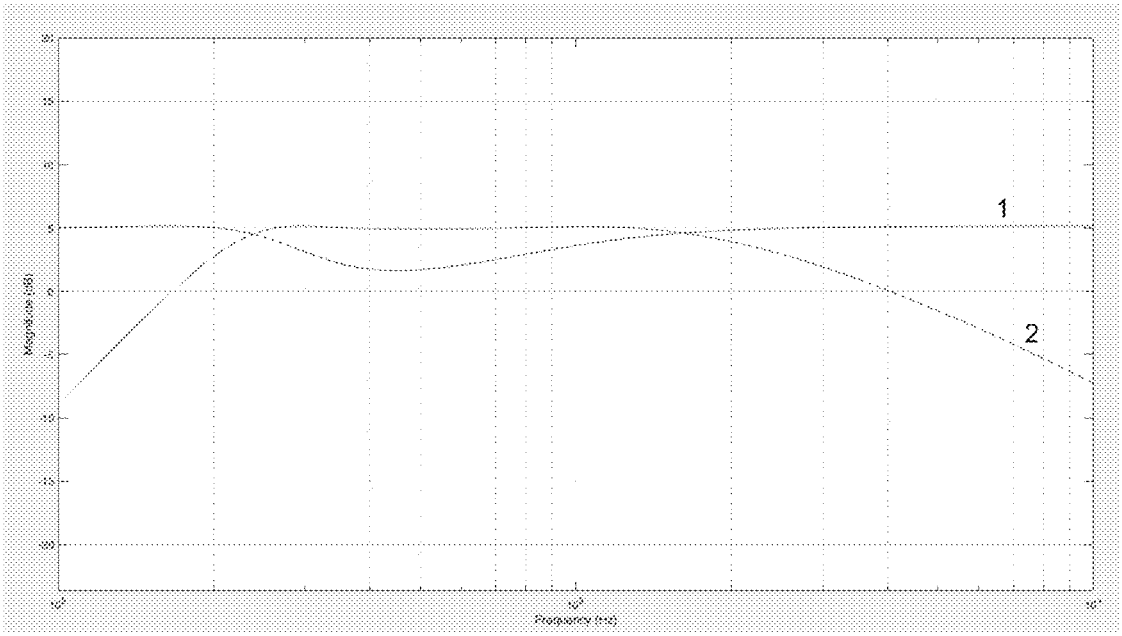
FIG. 9 (also referred to as Picture 9 herein) displays the different sound components in the sympathetic grouping.
Figure 10:
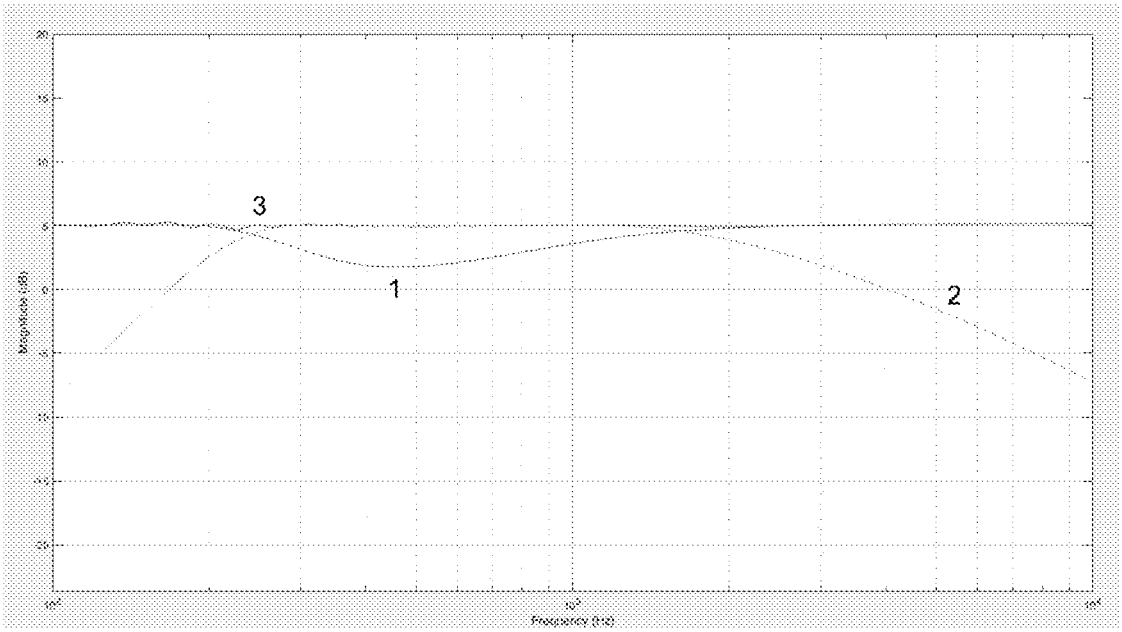
FIG. 10 (also referred to as Picture 10 herein) shows again trace 1 direct sound and trace 2 ambient information together with trace 3, which is the complex summation between the two former.

At first, sound was recorded and played back in mono. The mono process can at best provide some perceived depth and height of the soundstage projected in front of the listener but it is basically unable to convey any localization clues for the individual sound sources in the recording. The limited soundstage that is available is created by reflections from surfaces in the listening room. The reflections create an illusion of a cloud of sound around the single loudspeaker source. This can easily be verified by listening to mono in an anechoic environment where the cloud disappears.

In 1931 Alan Blumlein invented the stereo process. Stereo was an unfolded version of mono, unfolded in the physical horizontal plane by the use of two loudspeakers. It allowed localization of sound sources horizontally anywhere between the loudspeakers. When stereo is properly recorded and played back on loudspeakers it manages to create a relatively continuous horizontal plane of sound in front of the listener with some height and depth present. The listener's brain is fooled by the process into believing that there are multiple sound sources in front of him/her despite the fact that all sound only emanates from two speakers. Stereo played back through loudspeakers makes use of psychoacoustics to create an illusion of a soundstage populated by multiple sound sources at different horizontal locations in front of the listener. As with mono, reflected sound from the loudspeakers, reflected by the surfaces within the listening room, creates the illusion of a soundstage in front of the listener. Without these reflections, the sound would be perceived as emanating from inside of the listener's head.

The reason for this phenomenon is that stereo recordings only contain left to right localization clues and are missing all additional spatial information [5]. The stereo process doesn't provide any psychoacoustic clues that would enable a human brain to figure out any other spatial information than left to right localization. This is easy to test by listening to a stereo recording using headphones, the sound is invariably located inside the listener's head between the ears. With a pair of highly directional speakers, parabolic speakers or speakers in an anechoic room, similarly the sound stage is located within the listener's head.

If recordings where made with individualized HTRFs, i.e. one custom dummy head for every person that is going to listen to the recording, there would be individualized psychoacoustic clues embedded within each recording and we could listen to headphones and decode the spatial information properly. Unfortunately, this can't be done for obvious reasons so we are left with recordings that lack any meaningful spatial information, at least for the human brain.

By now most people are quite used to stereophonic reproduction and are very familiar with its limitations, to the point where they don't think much about them anymore. This doesn't mean that the difference between stereophonic reproduction and live sound is inaudible, most would agree that it's easy to distinguish between live and stereo reproduced sound, it's just that we don't expect stereo to sound like live sound and automatically changes our expectations.

At best, using ordinary properly setup loudspeakers, stereo reproduction can project a sound stage with depth, width and height. The sound sources within that soundstage unfortunately sound like they were paper cutouts of performers without any individual extension in depth. Furthermore, the paper cutouts perform in solitude without being in an acoustic space, almost like flashlights suspended in a black room projecting their sound only straight forward towards the listener. There is some ambience information present in stereo reproduction that allows us to hear the acoustic surroundings in which the recording was made but it is not anything remotely resembling the acoustics of a real space. Picture 1 of a symphony orchestra and two speakers tries to visually illustrate the sound from stereo. Most of the soundstage is perceived as being in between the two speakers with a little bit of height and depth and virtually no acoustic surrounding.

Stereo Unfold EV

The Stereo Unfold Technology creates a real believable three-dimensional soundstage populated with three-dimensional sound sources generating sound in a continuous real sounding acoustic environment. Picture 2 tries to visually illustrate the perceived soundstage from Stereo Unfold and it should be compared to Picture 1 that is illustrating ordinary stereo. The performers are located approximately at the same locations somewhat enlarged in size, the hall and ambiance is added providing the predominant enlargement as well as a 3D quality to the sound.

As implied by the name, Stereo Unfold is unfolding the ordinary stereo recording much like mono once was unfolded physically into left/right stereo but this time stereo is unfolded in the dimension of time. The jump from stereo to Stereo Unfold is psychoacoustically actually not much different from physically unfolding mono into stereo. This might sound inexplicable but let's take a closer look at stereo and how it works psychoacoustically and it will become apparent that it's not.

The localization of sound sources from left to right in stereo playback works through two main psychoacoustic phenomena. Our ear brain judges horizontal localization of a sound source based on inter aural time differences and perceived level differences between left and right ear. It is possible to pan a sound source from left to right by adjusting the level from the source in the right and left ear respectively. This is usually referred to as level panning. It is also possible to adjust the localization by changing the arrival time to the left and right ear and this panning method is the more effective of the two. It is easy to test the effectiveness of panning through inter aural time difference. Set up a stereo speaker pair in front of a listener and allow the listener to move away to the left or right from the centrally located position between the speakers. The perceived soundstage rather quickly collapses towards one of the stereo speakers because the inter aural time difference psychoacoustically tells us that the closer speaker is the source. The same can be illustrated using headphones, by delaying the stereo signal to one of the ears the whole soundstage collapses towards the non-delayed ear without any change in level. Localization in the horizontal plane in stereo is actually predominantly caused by the inter aural time difference between the left and right signals, i.e. stereo is a mono signal unfolded in time to generate psychoacoustic horizontal localization clues based on time differences between the ears. Blumlein used the physical separation of two speakers to be able to create the necessary inter aural time difference for the creation of left to right localization.

Now, if we, similarly as mono was unfolded into stereo, unfold the stereo signals in time we will psychoacoustically be able to unfold stereo into a true three dimensional sound. This is what Stereo Unfold does.

Picture 3 shows one channel of an ordinary digital stereo sound recording. Along the axis starting to the left and ending in the middle of the picture we have sound samples on the real time domain axis. The graph displays the absolute value of the sound signal at each instance in time, height corresponding to level. Along the axis from the right to the middle of the picture we have the second dimension of time. In the original stereo recording there is no additional information in this dimension since stereo is just a two-dimensional process only containing left and right signals.

Picture 4 shows the same digital stereo sound recording as Picture 3. The difference is that it has now been Stereo Unfold processed. It has been unfolded in time and along the axis from right to center we can now see how the signal at each instance in time is unfolded into the secondary time dimension. In the diagram it can be observed that the signal is unfolded by an unfold process using 20 discrete unfold signal feeds along the secondary time axis. The concept of the 3D-graph in Picture 4 is perhaps somewhat strange on first look but it very much resembles how the human brain interprets sound. A sound heard at a certain point in time is tracked by the brain along the secondary time axis and all information from the onset of the original signal up to the end in the diagram is used by the brain to obtain information about the sound.

The brain tries to make sense of our sound environment in much the same way as our vision. It simplifies the sound environment by creating objects and assigning particular sounds to each object [2]. We hear the doorbell as an object together with the attendant reverberation, when a person walks across the room we assign all the sounds from the movement to the person etc. An example from our visual perception and grouping perhaps makes the details easier to understand. Think about a small tree with green leaves and a man standing behind the tree. Looking at the tree and man we immediately group the branches and leaves of the tree together into a tree object and we deduct from the portions that are visible of the man behind the tree that there is another object, although only partially visible at this point, and groups it into the man group. Our perception of the man group is limited since the leaves obscures most of the man but still we manage to tell with reasonable certainty that it is a separate group and most likely it's a man. The visual example is similar to how our hearing works and how the brain decodes and groups sound. Even if the brain only has partial limited information it is still possible to perceive and group sound objects, much like the man behind the tree. The less information we hear the harder it is with certainty to sort out details and group but it's still possible, the brain only has to work harder. If the tree didn't have any leaves, we would be able to see more details and perceive the man group behind the tree much easier and with greater certainty.

With this in mind, take another look at the differences between Picture 3 and 4. In the unfolded version of the signal in Picture 4 there is a lot more information about the sound and consequently makes it easier for the brain to sort out, perceive details and group the sound. This is exactly what's heard with Stereo Unfold compared to ordinary stereo, increased ease and an increased perception of details. The acoustic environment and decay associated with each sound becomes much clearer and the soundstage takes on a 3D quality that isn't present with ordinary stereo. The overall size of the soundstage is also significantly increased.

The graph in Picture 4 has two time dimensions and the additional second time dimension in the matrix is during the processing dimension folded into the real time dimension.

Stereophonic Reproduction and its Limitations

The issue with stereo has its roots in the lack of spatial information within the recoding and reproduction chain. A recording engineer would not place a recoding microphone at a typical listening position in a concert hall. He would invariably move the microphone much closer to the performers. If the microphone was located out in the hall where the audience usually sits the recording would sound excessively reverberant an unnatural. This happens because the stereo recording fails to capture the spatial information properties from the sound field in the hall. It only captures the sound pressure level. A human listener in the hall would capture all of the information, both sound pressure and spatial, and would automatically use the spatial information to focus his/her attention to the performers on stage and as input to the psychoacoustic grouping process discussed later. The ambient sound field is reaching the listener from other directions and is perceptibly observed differently by the brain compared to the sound from the stage. Since spatial information is missing from stereo recordings the listener can't use spatial information to decode the sound and therefore, if the recording was made at the listening position in the hall, it would be perceived as having copious amounts of reverberant energy. The human brain uses both the spatial domain as well as the sound pressure domain to understand and process the sound environment.

Barron investigated the ratio between reflected energy and direct energy and created a diagram that ranges from −25 dB to +5 dB (D/R) to cover any normal circumstances [1]. In a typical shoebox concert hall at least half the seats have a D/R of −8 dB or less [4]. In nearly all stereophonic recordings the D/R ratio is never less than +4 dB, i.e. there is at least a 12 dB difference between the recoding and the sound in the concert hall. This is necessary since the recoding lacks spatial information and listeners can't distinguish the reverberant field in the recording from the direct sound. If the recoding contained as much reverberant energy as present in the hall it would sound disproportionately reverberant.

Picture 5, shows two cross sections of two rooms. The larger room is a typical concert hall with a stage section to the left and the audience space to the right. There's a single performer on stage and a single listener in the audience. The sound emanates from the performer on stage travelling along a number of imaginable paths illustrated in the picture. The direct sound travels directly from the performer to the listener without reflecting on any surfaces within the hall. As can be seen, the path of the direct sound is much shorter than the path of the first reflection reaching the listener which creates an appreciable arrival time difference.

The smaller room at the bottom in Picture 5 is a typical listening room with a loudspeaker to the left and a listener to the right. Again soundwave paths are illustrated in the picture with a direct path and reflected paths. In the smaller room the path length difference between the direct sound and the first reflection is smaller than in the larger hall which translates into a smaller arrival time difference.

One of the fundamental differences between the hall and the room is the reverberation time. The larger hall has a much longer reverberation time than the small room. In a larger space, over the same time, there are fewer sound wave reflections. In the large space, sound has to travel a longer distance before reaching the next reflecting surface that absorbs energy from the sound field and thus the sound lingers for a longer period of time in the larger space.

Picture 6 illustrates the arrival of sound at the listener's ears in five different diagrams. Along the X-axis is time and on the Y-axis is level. The five diagrams show reverberant decay spectra from an impulse sound. Diagram 1 is from the concert hall in Picture 5, diagram 2 is from the listening room in Picture 5, diagram 3 is a stereo recording made in the concert hall shown in diagram 1, diagram 4 is the stereo recoding played back in the listening room and finally diagram 5 shows the stereo recoding played back in the listening room after it has been Stereo Unfold processed.

In the first diagram in Picture 6 from the concert hall in Picture 1 the first peak to the left is the direct sound arriving from the performer to the listener. The next peak is the first reflection arriving after a certain time delay. Following the first are the later reflections, first those that have bounced on only one surface sparsely spaced followed by an increasingly dense array of reflections from multiple bounces. This is typical impulse response decay observable in many halls.

The second diagram in Picture 2 shows the same kind of sound arrival as the first diagram but now it is shown from the typical listening room in Picture 5. Again we have the direct sound, the first peak, followed by the early somewhat sparsely spaced reflections and the denser multiple reflection paths that follows. The sound in the small room is absorbed quicker than in the hall which is clearly illustrated by comparing the sound decay in diagram one and two in Picture 6.

The most critical difference between the hall and the room is the timing of the first reflection in relation to the direct sound. It's well known from concert hall acoustics that there should be about 25 ms to 35 ms between the direct sound arrival and the first reflection to maintain clarity and intelligibility of the sound in the hall. If this time is reduced the sound becomes less clear, unprecise even to a point where it becomes fatiguing. The small room isn't physically large enough to provide us with this amount of delay and therefore added ambient energy in the room invariably makes the sound less clear.

Picture 6 diagram 3 illustrates the reverberant decay in a stereo recording captured in the hall illustrated in Picture 5. A difference between the recording and the hall shown in Picture 6 diagram 1 exist because as discussed above the recording engineer had to move the microphone closer to the performer to balance the stereo recording. Since the microphone now is much closer to the performer the hall reflections are attenuated in relation to the direct sound. Additionally, the recorded reflections are not predominantly those of the main hall anymore but due to the physically closer proximity of the adjacent surfaces in the stage section those become dominant rather than the sparsely spaced reflections in the main audience section of the hall. On the whole it is rather obvious looking at the diagrams that the entire captured reverberant field in the stereo recording is not very similar to the naturally occurring field at the listening position in the hall.

Picture 6 diagram 4 shows what happens when the recording shown in Picture 6 diagram 3 is played back by the speakers and room with a reverberant decay illustrated in Picture 6 diagram 2. Here the recorded reverberant decay becomes superimposed on the room reverberant decay resulting in the composite reverberant decay in Picture 6 diagram 4. This still doesn't at all look like the reverberant decay of the hall in Picture 6 diagram 1 but it's the decay typically found in a listening room upon playback of a stereo recording.

As mentioned before the lack of time spacing between direct sound and first reflection makes the sound less clear and precise to the point of becoming fatiguing. The small room sound clearly causes trouble for the human brain and it also lacks enough reverberant decay energy to emulate a concert hall.

Considering that stereo sound lacks all spatial information, the spatial sound field is only created within the listening room by the speakers and the room together, and that the decay pattern looks very dissimilar to what naturally occurs in a music hall missing about 12 dB of reverberant energy it's not very surprising that stereo sounds artificial.

Stereo Unfold addresses the two fundamental limitations in stereo by regenerating a psychoacoustically based spatial 3D sound field that the human brain can easily interpret and by utilizing the psychoacoustic effect called psychoacoustic grouping.

In the first implementation Stereo Unfold creates a spatial 3D sound field in the listening room through the use of additional drivers in other directions than forward together with basic grouping of the spatial field and the direct sound.

In a second implementation Stereo Unfold uses the disclosed enhanced grouping method together with ordinary loudspeakers. The forward radiating loudspeaker essentially first plays back the stereo information and then later the grouped spatial information to recreate the spatial field without the use of additional drivers aimed in other directions than forward. This is possible through the use of the enhanced grouping process that uses the later described sympathetic grouping method.

In a third implementation Stereo Unfold creates a spatial 3D sound field in the listening room through the use of additional drivers in other directions than forward together with enhanced grouping of the spatial field and the direct sound. This implementation recreates the best illusion but needs additional drivers and is thus somewhat limited in its applicability compared to the second implementation.

In a fourth implementation Stereo Unfold processing creates a spatial 3D sound field with headphones using the enhanced grouping process. The direct and ambient sound fields are connected through enhanced grouping which moves the sound experience from the common within the listener's head to outside of the listener's head. It does so without any prior information about the listener's physical properties, i.e. shape and size of ears, head and shoulders.

Stereo Unfold EV Extraction Process

The Stereo Unfold EV DSP extraction process creates additional basic L+R, L−R and R−L feeds that are used as building blocks together with the original L and R channels in the unfold processing. The equations for the basic feeds (Fx) are show below; Gx, Dx, and Frx denotes gain, delay and frequency shaping respectively, Gfx are gain multiplies to adjust forward main output in level to maintain same perceived output level after the Stereo Unfold EV processing and Frfx are frequency shaping filters that can be modified to maintain the overall tonal balance of the forward direct sound.

$$F1=L*Gf1*Frf1$$

$$F2=R*Gf2*Frf2$$

$$F3=L*G1*Fr1*D1$$

$$F4=R*G2*Fr2*D2$$

$$F5=(L*G3*Fr3*D3)+(R*G4*Fr4*D4)$$

$$F6=(L*G5*Fr5*D5)-(R*G6*Fr6*D6)$$

$$F7=(R*G7*Fr7*D7)-(L*G8*Fr8*D8)$$

$$F8=L*G9*Fr9*D9$$

$$F9=R*G10*Fr10*D10$$

The Gx gain multipliers can be any number between 0 and infinity. The frequency shaping, Frx, predominantly limits the frequency range to above 50 Hz and rolls of frequencies above 7 kHz to emulate typical reverberant field energy in a concert hall and naturally occurring absorption of higher frequencies in air. The preferred frequency range being 100 Hz to 4 kHz. It also contours the response to follow the roll of in an ambient sound field similar to what's naturally occurring in concert halls. The delays D1 and D2 are between 0 ms-3 ms, the rest of Dx are at least 5 ms up to 50 ms, preferred range 10 ms-40 ms, further preferred range 15 ms-35 ms. The shown basic feeds F3-F9 can each become several input feeds to the processing with different Gx, Frx and Dx settings. In the below following text and equations a reference to any of the feeds F3 to F9 denotes at least one but can also be two, three, four, five or several more of the same basic feed with different Gx, Frx, and Dx in each instance.

In a basic implementation of Stereo Unfold EV using 5 unfold feeds the following signals are played back according to the equations.

$$\text{Left Channel}=F1+F3+F6+F8+F5$$

$$\text{Right Channel}=F2+F4+F7+F8+F5$$

In a very simple implementation down to minimum 3 unfold feeds can be used. An enhanced version can utilize 20 feeds as illustrated in Picture 4 and there is no upper limit of number of feeds, it's only limited by available DSP processing resources. Going above 30 feeds with perceptibly significant contents only brings limited advantages to the audible experience and could become detrimental so a preferred range is between 3 to 30 feeds. Below 3 feeds doesn't work since there is no psychoacoustically valid grouping information and the result is compromised.

Another basic implementation of Stereo Unfold EV using 3 Unfold feeds, the signals are played back according to the following equations.

$$\text{Left Channel}=F1+F3+F6$$

$$\text{Right Channel}=F2+F4+F7$$

In a more advanced implementation of Stereo Unfold EV using 12 Unfold feeds, the signals are played back according to the following equations. The "2*" denotes the number of times each feed is used with different parameters for Gx, Frx, and Dx in each instance.

$$\text{Left Channel}=F1+2*F3+4*F6+2*F8+F5$$

$$\text{Right Channel}=F2+2*F4+4*F7+2*F8+F5$$

There are of course an infinite number of possible combinations and all can't be exemplified but the general approach should now be apparent. The Left and Right Channel signals in the examples can be played back both through headphones and/or ordinary loudspeakers.

When played back through loudspeakers, in addition to the Left Channel and Right Channel signals, the Stereo Unfold EV feeds without the F1 and F2 components can also be sent to drivers aimed in other directions than directly towards the listener. Additional feeds can be sent in one or all possible extra directions, in, out, up, back and down, using any type of loudspeaker drivers or arrays thereof. Basically any type of constellation that generates a diffuse widespread sound field will work. Also additional separate loudspeakers can be used for the additional feeds located close to or even possibly attached to the main speakers. Separate loudspeakers can also be located around the room similar to a surround setup or integrated into the walls and ceiling. Also any type combination of the above is possible and will work.

Stereo Unfold EV Psychoacoustic Grouping Process

The psychoacoustic grouping phenomenon is core to the Stereo Unfold EV process. Without grouping the brain would not connect the time layered feeds together and they would not provide additional information to the brain, rather the opposite, they would provide confusion and would make the sound less clear and less intelligible. Grouping is easier to describe in an uncomplicated example so let's take a closer look at the Left channel signals in the 3. Unfold feed example above with the output equation;

$$\text{Left Channel}=F1+F3+F6.$$

In this case we have a sound in the F1 direct feed that also appears in the F3 and F6 feeds and we need to group them. The better and more stable the psychoacoustic grouping is the better the audible result become and intelligibility improves.

It is understood from psychoacoustic research that grouping occurs based on phase relationship and frequency relationship of the original direct sound signal and the added information. If the frequency shape differs between direct sound and added feed the added feed need to retain a phase and frequency contents that is in line with what the human brain expects from a signal present in a real acoustic environment. What this means is that if we have a direct sound and a second feed that arrives a certain time later the brain would expect the second signal to have less high frequency contents than the direct sound dependent on the distance and time it traveled to reach the listener. A signal that has traveled for 25 ms, equating approximately 8.5 meters, have to exhibit high frequency roll off at least equal to the amount present in air at that distance. If it has the same frequency contents as the direct signal it will be confusing for the brain and the brain won't group it with the direct sound as intended. If it has less high frequency contents it becomes more believable since the sound apart from just travelling in air most likely also bounced on at least one object and that the reflection in itself also removed high frequency contents. Similarly, a reflection of a smaller object won't bounce much of the low frequency energy back and the reflected sound will be rolled of below a certain frequency depending on the physical size of the object in relation to the wave length. In essence, to achieve good grouping the signals in F1, F3 and F6 need to adhere to the laws of physics and they need to have similar frequency contents modified according to travel distance etc. as described.

Another important propriety is phase relationship. If the signals in feed F1 and F6 are random in their phase relationships they won't be grouped.

The low frequency roll off in combination with the delay work together to establish grouping and sympathetic grouping occurs at different combinations of delays and frequency roll off. If we roll off at say 250 Hz a delay causing sympathetic grouping would be a multiple of the fundamental, i.e. 4 ms*6=24 ms. It has been found that although the delay is long compared to the fundamental frequency it is important that the lowest frequency still is in phase with the direct feed for a good grouping to occur. The example above gives us a delay of 24 ms. This is not an exact value in the sense that it needs to be exactly 24 ms or grouping won't occur. It's rather a middle point within a range where grouping occurs and should be viewed as a guiding point towards a delay where grouping will occur. Also, grouping occurs at other multiples than 6, i.e. it is possible to use different multiples to create varying audible results. A larger multiple would be perceived as creating a more spacious sound up to a point where the sound starts to be perceived as an echo at delays larger than 50 ms. A lower multiple creates a less spacious sound and if the total delay time is less than 10 ms the sound starts to become unclear and difficult for the human brain to separate from the direct sound.

The F3 feed is needed to group together with F1 and F6 in order to provide phase stabilization to the sound. The F6 feed is essentially an L-R feed and as such if added in significant amounts will cause a somewhat unpleasant phasiness to the sound to a certain degree similar to what happens when playing back stereo contents with one of the speakers out of phase. To counter act this phenomenon the F3 feed is provided as a stabilizing element that removes the phasiness and when grouped with the F1 and F6 feeds there is no phasiness present anymore.

Stereo Unfold EV Sympathetic Grouping

The human brain uses both spatial information and sound pressure information to decode, group and in general make sense of the acoustic environment. If the spatial information is removed by the stereo recoding method the natural grouping process stops working. Normally the ambient sound energy is significantly larger than the direct sound energy and when the spatial information is lost the brain can't suppress and handle the ambient sound information in the same way it does when it has access to the spatial information. The naturally occurring grouping of sound objects, where each group contains the direct and reflected sound, stops working. The lack of grouping causes the familiar subjective huge increase of ambient sound energy in a stereo recording and is the reason ambient energy has to be decreased.

To make grouping possible without spatial information and to be able to restore the naturally occurring direct to ambient energy ratios sympathetic grouping is required.

In a natural sound environment the phase relationship between direct and reflected sound is random and depends on location of sound source and listener in relation to surfaces in the environment. With help of the spatial information the brain is able to sort out what is direct and reflected sound and perceptibly decode them differently. It also adds the different contributing parts of the sound, direct and reflected sound, together so that they still are perceived to be sympathetically grouped together, i.e. in phase.

Live sound from performers and instruments is perceived to be full bodied and rich in comparison to stereo recordings made in listening positions. The reason is that with live sound the brain has access to spatial information and adds the grouped sounds together so they perceptibly sound like they are in phase. When the spatial information is removed it can't do that anymore and the summation of the sounds becomes random in phase. The summation takes place in the same way as a simple energy addition of sound with random phase relationships.

Picture 7 show a complex summation of sound pressure from multiple sources with random phase relationships similar to what typically occurs in a room. The trace in the diagram is one octave smoothed to take away the local cancellation dips and peaks caused by the random summation and show the overall average level at a particular frequency. It is clear that the random summation causes a broad dip in the frequency response in the fundamental frequency range between approximately 120 Hz-400 Hz. It also creates a broad peak between approximately 400 Hz-2 kHz. This corresponds very well with the perception of tonal balance in a recording made at listening position. Normally such a recording sounds like it's made in a tiled very reverberant space lacking fundamental energy with emphasis in the low to upper midrange. This is the typical sound heard with natural levels of ambient energy without spatial information. This clearly sounds very unnatural and hence the countermeasures mentioned earlier, moving microphones closer to the source and attenuating ambient energy, are applied by the recording engineer to make the recording sound more natural and tonally balanced.

Picture 8 shows the same one octave smoothed frequency response with sympathetic grouping applied instead of random phase summation. The frequency response is now very even throughout the entire frequency spectrum and there is very little change of tonal balance. The response only shows some very small wiggles in the 120 Hz-400 Hz range that will not perceptibly change the tonal balance.

Picture 9 displays the different sound components in the sympathetic grouping. Trace 1 is the direct sound and trace 2 is the ambient sound feed. The lower cutoff frequency of the ambient sound feed is about 250 Hz and it is delayed 24 ms as described in the example earlier. The ambient level is brought up to restore the ambient to direct sound ratio to, in an acoustic space, normally occurring levels. The ambient sound is also attenuated at higher frequencies similarly to the way it would normally be in an acoustic space. The direct sound's frequency balance, trace 1, is modified so that the summation between the restored ambient sound and the direct sound becomes even across the whole frequency spectra.

Picture 10 shows again trace 1 direct sound and trace 2 ambient information together with trace 3, which is the complex summation between the two former. Trace 3 in picture 10 was shown individually in Picture 8 above.

Applications & Technical Solution

Stereo Unfold EV can be applied to a sound recording at any stage. It can be applied on old recordings or it can be applied in the process of making new ones. It can be applied off line as a preprocess that adds the Stereo Unfold EV information to recordings or it can be applied whilst the sound recording is played back.

There are multiple ways of implementing it into products, it could be either in hardware form in an integrated circuit on a chip, FPGA, DSP, processor or similar. Any type of hardware solution that allows the described processing can be used. It can also be implemented into a hardware platform as firmware or software that runs on an already present processing device such as a DSP, processor, FPGA or similar. Such a platform could be a personal computer, phone, pad, dedicated sound processing device, TV set etc.

The Stereo Unfold EV can then be implemented in any type of preprocessing or playback device imaginable either as hardware, software or firmware as described above. Some examples of such devices are active speakers, amplifiers, DA converters, PC music systems, TV sets, headphone amplifiers, smartphones, phones, pads, sound processing units for mastering and recording industry, software plugins in professional mastering and mixing software, software plugins for media players, processing of streaming media in software players, preprocessing software modules or hardware units for preprocessing of streaming contents or preprocessing software modules or hardware units for preprocessing of any type of recording.

Other Application Areas

During the work with Stereo Unfold EV we have also discovered that the improvement in clarity of the sound perceived by a normal listener is of even greater importance to a listener with hearing impairment. Listeners with hearing impairment are regularly struggling with intelligibility of sound and any relief brought is of great help.

The added clues provided by Stereo Unfold EV reduce the difficulties by offering more information for the brain to decode and more clues result in greater intelligibility. It is therefore highly likely that the technology would be of great benefit in devices for the hearing impaired such as hearing aids, cochlear implants, conversation amplifiers etc.

Stereo Unfold EV could also likely be applied in PA sound distribution systems to improve intelligibility for everyone in sonically difficult environments such as but not limited to train stations and airports. Stereo Unfold EV can offer benefits in all types of applications where the intelligibility of sound is of concern.

Stereo Unfold EV is just as appropriate in PA systems for sound reinforcement to enhance the intelligibility and sound quality of typically music and speech. It could be used in any type of live or playback performances in stadia, auditoria, conference venues, concert halls, churches, cinemas, outdoor concerts etc.

In addition to unfolding stereo sources in time the Stereo Unfold EV can be used to unfold mono sources similarly as it does stereo sources in time with psychoacoustic grouping to enhance the experience either from an intelligibility point of view or to provide improved playback performance in general.

It can also be used in systems with just one single Mono speaker for playback. If the left and right contents is decorrelated in time in relation to each other before being summed for one speaker playback the unfold processing sounds and works similarly as it does with two speakers.

The Stereo Unfold EV process is also not limited to a stereo playback system but could be used in any surround sound setup as well with processing, unfolding in time and grouping, occurring in the individual surround channels.

DIFFERENT EMBODIMENTS ACCORDING TO THE PRESENT INVENTION

According to a first aspect of the present invention, there is provided a method for reproduction of sound, said method comprising:

- providing a number of unfolded feeds (Fx) which are processed algorithms of sound signal(s);
- psychoacoustic grouping at least one unfolded feed (Fx) with another one or more; and
- playing back an unfolded and psychoacoustically grouped feed sound in a sound reproduction unit;

wherein the number of unfolded feeds (Fx) are at least 3, such as in the range of 3-30.

The method may also comprise a step of

- providing extracted information from a Left (L) channel and Right (R) channel by utilizing DSP (digital signal processing) and the step of providing a number of unfolded feeds (Fx) are based on the extracted information from the Left (L) channel and Right (R) channel.

As may be understood from above, according to one embodiment of the present invention it is directed to providing a method for stereo sound reproduction, meaning that the Left (L) channel and Right (R) channels are Left (L) and Right (R) stereo channels. As notable above, stereo is only one possible of many technical applications where the present invention finds use.

According to yet another specific embodiment, delay(s) (Dx) and/or frequency shaping(s) (Frx) are utilized in the processed algorithms. In one embodiment delay(s) (Dx) are utilized in the processed algorithms. According to another embodiment, delay(s) (Dx) and frequency shaping(s) (Frx) are utilized in the processed algorithms. Moreover, according to yet another embodiment, gain(s) (Gx) are also utilized in the processed algorithms.

Furthermore, the method may also involve frequency shaping(s) (Frx). According to one embodiment, frequency shaping(s) (Frx) are utilized and the frequency shaping(s) (Frx) predominantly limits the frequency range to above 50 Hz. According to yet another embodiment, frequency shaping(s) (Frx) are utilized and the frequency shaping(s) (Frx)

is performed so that the higher frequency contents are rolled of above 7 kHz. According to yet another embodiment, frequency shaping(s) (Frx) are utilized and the frequency shaping(s) (Frx) is performed in a frequency range of from 100 Hz to 4 kHz.

Also the delay(s) is(are) of relevance. According to one specific embodiment of the present invention, the first two delays D1 and D2 are in the range of 0-3 ms. According to yet another embodiment, all delays except D1 and D2 are at least 5 ms, such as in the range of from 5-50 ms, preferably in the range of 10-40 ms, more preferably in the range of 15-35 ms.

Moreover, according to yet another embodiment, one or more feeds (Fx) are provided as a phase stabilizer. Furthermore, according to yet another specific embodiment, the feeds (Fx) are psychoacoustically grouped by means of using multiple(s) of the fundamental(s). Moreover, several feeds (Fx) may be modified to have similar frequency contents.

It should be noted that all of the above features also apply if to be used in stereo sound reproduction. In such cases these are to be used for the Left (L) and Right (R) stereo channels, respectively. As understood from above, the present invention is directed to grouping feeds (Fx). Therefore, according to one specific embodiment, the feeds (Fx) are psychoacoustically grouped in a Left (L) and (R) stereo channel, respectively.

The present invention is also directed to a device arranged to provide sound reproduction by a method comprising:

providing a number of unfolded feeds (Fx) which are processed algorithms of sound signal(s);

psychoacoustic grouping at least one unfolded feed (Fx) with another one or more; and playing back an unfolded and psychoacoustically grouped feed sound in a sound reproduction unit;

wherein the number of unfolded feeds (Fx) are at least 3.

Also in this case, the device may be any type of sound recording unit, such as in any type of stereo units, amplifiers etc.

According to one specific embodiment, the device is an integrated circuit on a chip, FPGA or processor. According to yet another embodiment, the device is implemented into a hardware platform. As understood from above, the method according to the present invention may also be utilized in software applications.

REFERENCES

[1] Barron, Michael "Auditorium Acoustics and Architectural Design" E&FN SPON 1993

[2] Albert S. Bregman, Auditory Scene Analysis The Perceptual Organization of Sound, 1994, ISBN 978-0-262-52195-6

[3] David Griesinger, The importance of the direct to reverberant ratio in the perception of distance, localization, clarity, and envelopment, Presented at the 122nd Convention of the Audio Engineering Society, 2007 May 5-8 Vienna, Austria

[4] David Griesinger, Perception of Concert Hall Acoustics in seats where the reflected energy is stronger than the direct energy, Presented at the 122nd Convention of the Audio Engineering Society
2007 May 5-8 Vienna, Austria

[5] David Griesinger, Pitch, Timbre, Source Separation and the Myths of Loudspeaker Imaging, Presented at the 132nd Convention of the Audio Engineering Society 2012 Apr. 26-29, Budapest, Hungary

The invention claimed is:

1. A method for reproduction of sound, said method comprising:

providing a number of unfolded feeds (Fx) which are processed algorithms of sound signal(s);

psychoacoustic grouping at least one unfolded feed (Fx) with another one or more; and playing back an unfolded and psychoacoustically grouped feed sound in a sound reproduction unit;

wherein the number of unfolded feeds (Fx) are at least 3, wherein delay(s) (Dx) are utilized in the processed algorithms, and wherein all delays except first two delays D1 and D2 from the delay(s) (Dx) are at least 5 ms.

2. The method according to claim 1, wherein the method also comprises providing extracted information from a Left (L) channel and Right (R) channel by utilizing DSP (digital signal processing) and the step of providing a number of unfolded feeds (Fx) are based on the extracted information from the Left (L) channel and Right (R) channel.

3. The method according to claim 1, wherein frequency shaping(s) (Frx) is utilized in the processed algorithms.

4. The method according to claim 1, wherein delay(s) (Dx) and frequency shaping(s) (Frx) are utilized in the processed algorithms.

5. The method according to claim 1, wherein gain(s) (Gx) are also utilized in the processed algorithms.

6. The method according to claim 1, wherein frequency shaping(s) (Frx) are utilized and the frequency shaping(s) (Frx) predominantly limits the frequency range to above 50 Hz.

7. The method according to claim 1, wherein frequency shaping(s) (Frx) are utilized and the frequency shaping(s) (Frx) is performed so that the higher frequency contents are rolled of above 7 kHz.

8. The method according to claim 1, wherein frequency shaping(s) (Frx) are utilized and the frequency shaping(s) (Frx) is performed in a frequency range of from 100 Hz to 4 kHz.

9. The method according to claim 1, wherein all delays except the first two delays D1 and D2 are in the range of 5-50 ms.

10. The method according to claim 1, wherein the feeds (Fx) are psychoacoustically grouped in a Left (L) and (R) stereo channel, respectively.

11. The method according to claim 1, wherein one or more feeds (Fx) are provided as a phase stabilizer.

12. The method according to claim 1, wherein the feeds (Fx) are psychoacoustically grouped by means of using multiple(s) of fundamental(s).

13. The method according to claim 1, wherein several feeds (Fx) are modified to have similar frequency contents.

14. The method according to claim 1, wherein the number of feeds (Fx) are in the range of 3-30.

15. A device arranged to provide sound reproduction, the device including an integrated circuit on a chip, FPGA or processor configured to perform the operations comprising:

providing a number of unfolded feeds (Fx) which are processed algorithms of sound signal(s);

psychoacoustic grouping at least one unfolded feed (Fx) with another one or more; and playing back an unfolded and psychoacoustically grouped feed sound in a sound reproduction unit; wherein the number of unfolded feeds (Fx) are at least 3, wherein delay(s) (Dx) are utilized in the processed algorithms, and wherein all delays except first two delays D1 and D2 from the delay(s) (Dx) are at least 5 ms.

16. The device according to claim 15, wherein the device is implemented into a hardware platform.

* * * * *